US009127682B2

(12) United States Patent
Schofield

(10) Patent No.: US 9,127,682 B2
(45) Date of Patent: Sep. 8, 2015

(54) VACUUM PUMPING ARRANGEMENT

(75) Inventor: Nigel Paul Schofield, Horsham (GB)

(73) Assignee: Edwards Limited, Crawley, West Sussex (GB)

( * ) Notice: Subject to any disclaimer, the term of this patent is extended or adjusted under 35 U.S.C. 154(b) by 1321 days.

(21) Appl. No.: 12/083,591

(22) PCT Filed: Oct. 6, 2006

(86) PCT No.: PCT/GB2006/050320

§ 371 (c)(1),
(2), (4) Date: May 7, 2009

(87) PCT Pub. No.: WO2007/042842

PCT Pub. Date: Apr. 19, 2007

(65) Prior Publication Data

US 2009/0211653 A1 Aug. 27, 2009

(30) Foreign Application Priority Data

Oct. 12, 2005 (GB) ..... 0520750.1

(51) Int. Cl.
*F04D 19/04* (2006.01)
*B23P 11/00* (2006.01)
(Continued)

(52) U.S. Cl.
CPC ..... *F04D 19/042* (2013.01); *F04D 27/0292* (2013.01); *F04D 29/601* (2013.01); *Y10T 29/49948* (2015.01); *Y10T 137/86083* (2015.04)

(58) Field of Classification Search
CPC ..... F04D 27/008; F04D 29/601
USPC ..... 417/360
See application file for complete search history.

(56) References Cited

U.S. PATENT DOCUMENTS 6,032,925 A * 3/2000 Izuo et al. ..... 251/129.17
7,121,758 B2 * 10/2006 McMillan et al. ..... 403/408.1
(Continued)

FOREIGN PATENT DOCUMENTS

EP 1 258 634 A1 11/2002
EP 1 312 804 A1 5/2003
(Continued)

OTHER PUBLICATIONS

Kubo Masahide; English language abstract of publicaton No. JP10274189A, entitled "Turbo Molecular Pump," Shimadzu Corp; Oct. 13, 1998.

(Continued)

*Primary Examiner* — Nimeshkumar Patel
*Assistant Examiner* — Jacob R Stern
(74) *Attorney, Agent, or Firm* — Westman, Champlin & Koehler, P.A.

(57) ABSTRACT

A vacuum pumping arrangement for evacuating an enclosure is provided. The arrangement comprises a turbomolecular vacuum pump having an inlet which is connectable using fixing members to an outlet of an enclosure to be evacuated. Each of the fixing members passes through a first aperture in the inlet and through a second aperture in the outlet. An elongate, circumferentially extending cavity is provided extending from or adjacent to one of these apertures to accommodate a crushable insert. Energy transmitted to the fixing members by the turbomolecular vacuum pump during a failure thereof is thus absorbed by the deformation of the inserts. By absorbing a proportion of the energy in this way separation of the inlet from the outlet is thus inhibited.

16 Claims, 7 Drawing Sheets

(51) Int. Cl.
*F04D 29/60* (2006.01)
*F04D 27/02* (2006.01)

(56) References Cited

U.S. PATENT DOCUMENTS

| | | | | |
|---|---|---|---|---|
| 2003/0038499 | A1* | 2/2003 | Fox et al. | 296/68.1 |
| 2003/0095863 | A1* | 5/2003 | Okudera et al. | 415/90 |
| 2004/0016111 | A1* | 1/2004 | Mueller et al. | 29/700 |
| 2005/0047905 | A1* | 3/2005 | Kabasawa et al. | 415/90 |

FOREIGN PATENT DOCUMENTS

| | | | | |
|---|---|---|---|---|
| EP | 1 314 892 | A1 | 5/2003 | |
| EP | 1 413 761 | A2 | 4/2004 | |
| FR | 2 844 016 | | 3/2004 | |
| JP | S59175642 | A | 10/1984 | |
| JP | 8-114196 | | 5/1996 | |
| JP | 9164889 | A | 6/1997 | |
| JP | 10-274189 | | 10/1998 | |
| JP | 2001035131 | A | 2/2001 | |
| JP | 2001146811 | A | 5/2001 | |
| JP | 2001169803 | A | 6/2001 | |
| JP | 2005163267 | A | 6/2005 | |
| JP | 2005-180233 | | 7/2005 | |
| WO | WO 9403327 | A1 * | 2/1994 | B32B 3/12 |

OTHER PUBLICATIONS

Kubo Masahide; English language abstract of publication No. JP2005180233A, entitled "Molecular Pump," Shimadzu Corp; Jul. 7, 2005.

Okamura Tomoaki; English language abstract of publication No. JP 08114196, entitled "Turbo-Molecular Pump," Mitsubishi Heavy Ind Ltd; May 7, 1996.

United Kingdom Search Report of Application No. GB0520750.1; Claims searched: 1-23; Date of search: Jan. 27, 2006.

PCT Notification of Transmittal of the International Search Report and the Written Opinion of the International Searching Authority, or the Declaration of International Application No. PCT/GB2006/050320; Date of mailing Dec. 27, 2006.

PCT International Search Report of International application No. PCT/GB2006/050320; Date of mailing of the International Search Report: Dec. 27, 2006.

PCT Written Opinion of the International Searching Authority of International Application No. PCT/GB2006/050320; Date of mailing: Dec. 27, 2006.

Prosecution history of corresponding European Patent Application No. 06779663.1-2315 including: Response dated Dec. 1, 2008.

Prosecution history of corresponding Japanese Patent Application No. 2008-535106 including: Final Rejection dated Dec. 17, 2012; Notification of Reason for Rejection dated Dec. 26, 2011; Response dated Jun. 20, 2012; Response dated Jun. 27, 2012.

* cited by examiner

VACUUM PUMPING ARRANGEMENT

FIELD OF THE INVENTION

This invention relates to the field of turbomolecular pumps and the connection thereof to associated apparatus, and to a vacuum pumping arrangement including a turbomolecular pump.

BRIEF DESCRIPITON OF THE DRAWINGS

The invention is described below in greater detail, by way of example only, with reference to the accompanying drawings, in which.

DETAILED DESCRIPTION OF THE INVETNION

In use, the internal mechanism of a turbomolecular vacuum pump typically undergoes high speed rotational motion. A pump of this type may experience a fault during operation that leads to a loss of integrity of the mechanism, hereafter referred to as a crash condition. Under these circumstances, material from the rotating components of the pump clashes with the adjacent stationary components of the pump, thereby imparting a significant impulse thereto. This impulse causes a housing of the pump to try to rotate relative to its point of attachment, typically either a duct or an outlet of an enclosure to be evacuated, which consequently causes the join between the two components to experience a significant shearing load.

Figure 1:
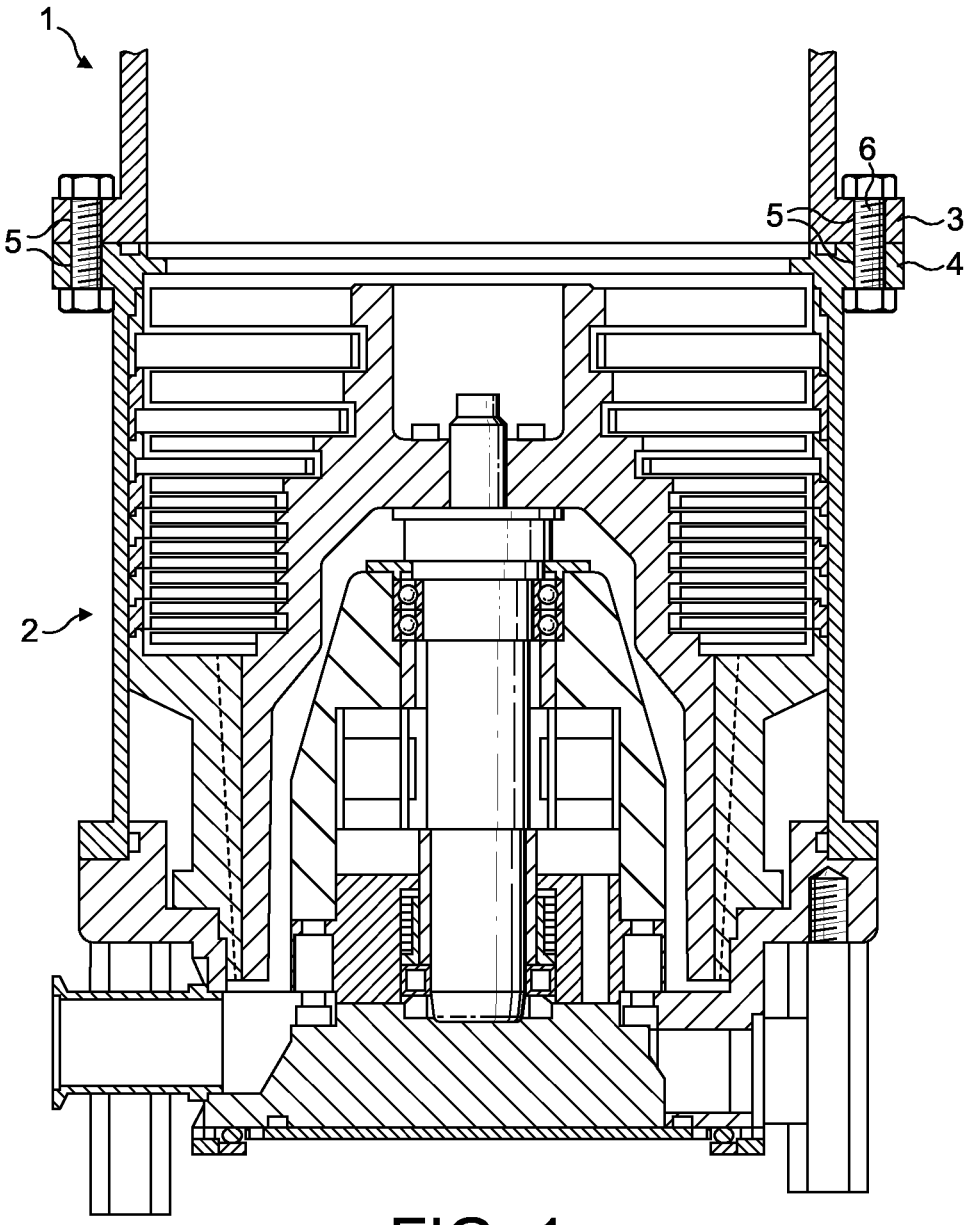
FIG. 1 (PRIOR ART)
FIG. 1 illustrates a conventional arrangement for connecting a turbomolecular pump to its associated equipment.

A typical configuration of mounting and attachment is represented in FIG. 1. Each component 1,2 is provided with a flange 3,4 each flange being provided with a number of apertures 5 that each cooperate with a respective aperture 5 in the opposing flange. A fixing member 6, typically a bolt, is inserted through each set of complementary apertures in order to fix one component 1,2 relative to the other 2,1. It is these fixing members 6 that experience the high shearing loads upon crash of the turbomolecular pump 2. The fixing members 6 absorb much of the shearing load generated by the crash through deformation and fracture thereof. An excess number of apertures 5 and bolts 6 are typically provided in an attempt to accommodate the load and to absorb all of the energy released during the crash thus to prevent the housing of the turbomolecular pump 2 from parting from its mounting point 1 such that a dangerous projectile is formed.

As the complexity of turbomolecular vacuum pumps increases, it is becoming more common to consider casting the housing component of the pump rather than to machine it from a solid billet of material.

In the case of aluminium, frequently the material of choice for the housing component of a turbomolecular vacuum pump, cast aluminium is typically very brittle. If the flange of the turbomolecular vacuum pump is made from cast aluminium a crash may lead to the flange being torn from the pump, as the bolts are likely to resist deformation to a greater degree than the flange material.

It is an aim of the present invention to enhance the energy absorbing properties of the join between two components in order to minimise the damage that occurs during the crash of a turbomolecular vacuum pump.

In an embodiment of the present invention, there is provided a vacuum pumping arrangement for evacuating an enclosure, the arrangement comprising:

a turbomolecular vacuum pump having an inlet connectable to an outlet of an enclosure using fixing members wherein each of the fixing members passes through a respective first aperture in the inlet and through a respective second aperture in the outlet, the inlet or the outlet comprising an elongate, circumferentially extending cavity extending from or adjacent to its respective aperture, and a crushable insert located within the cavity, so that energy transmitted to the fixing members by the turbomolecular vacuum pump during a failure thereof is absorbed by the crushable insert to inhibit separation of the inlet from the outlet.

Provision of a crushable insert in the inlet or the outlet permits some relative rotational motion between the inlet and outlet when the vacuum pump experiences a crash condition. Energy is absorbed from the system as the insert progressively deforms during this relative rotational motion. This reduction in energy ultimately leads to less damage being experienced by the inlet and the outlet themselves which, in turn, inhibits a loss of integrity of the vacuum pumping arrangement. Consequently there is a reduced likelihood of a projectile being formed when a crash condition is experienced and therefore safety of the pumping arrangement is enhanced.

The insert may comprise a cellular structure, for example having either a foam or a honeycomb configuration and may comprise an external skin covering at least part of an external surface of the crushable insert. This skin provides an additional source of deformable material and therefore of energy absorption. The insert may be composed of aluminium or an aluminium alloy. Alternatively, the insert may be composed of plastics material, optionally a fibre or particulate reinforced plastics material or a gel material. The insert may comprise a void for absorbing an initial impulse through collapse thereof.

If the cavity is provided in the inlet of the vacuum pump, the cavity may extend from the aperture in a direction opposite to the normal operation direction of a rotor mechanism of the vacuum pump. On the other hand, if the cavity is provided in the outlet of the enclosure, the cavity may extend from the aperture in a direction corresponding to the normal operational direction of a rotor mechanism of the vacuum pump. The cavity may extend in both directions from the aperture. The cavity may be provided adjacent to the aperture, but may be separated therefrom by a partition. The cavity may extend through a substantial part of the thickness of the material in which it is formed, such as a flange, or it may extend completely through said thickness. If a partition is provided and the cavity extends through only a substantial part of the thickness of the flange (or equivalent component), the remaining material provides an additional means for locating and securing the fixing member together with an additional source of deformable material and therefore of energy absorption during a crash condition experienced by the turbomolecular vacuum pump.

A bore for receiving the fixing member may be provided within the crushable insert to enhance location thereof upon assembly. The cavity and the insert may be provided with a complementary tapered or stepped profile to locate the insert within the cavity and prevent displacement therebetween during assembly of the vacuum pumping arrangement.

The insert may be configured to exhibit progressive resistive properties so that as the insert is deformed, an increasing level of resistance is presented to the deformation.

The outlet to which the vacuum pump is connected may be connected to a conduit or supplementary flange or adaptor extending from an enclosure to be evacuated or the vacuum pump may be connected to an outlet of the enclosure directly.

A plurality of crushable inserts may be provided, each insert being located in a respective cavity. The inserts may be arranged about a longitudinal axis of the vacuum pump. The outlet and the inlet may each be flanged and either or both flanges may be configured to receive one or more of the inserts. Consequently, according to another embodiment of the present invention, there is provided a turbomolecular vacuum pump comprising a flanged inlet connectable to a flanged duct using fixing members, wherein an array of cavities are provided in the inlet flange, each cavity extending from or adjacent to an aperture for receiving a respective fixing member and being configured to receive, or having located therein, a crushable insert.

According to another embodiment of the present invention there is provided a method of connecting a turbomolecular vacuum pump to a device to be evacuated, the method comprising the steps of:

- forming an array of elongate circumferentially extending cavities in a flanged inlet of the vacuum pump or a flanged outlet of the device, each cavity being adjacent to or extending from a respective aperture located in the flange;
- placing a crushable insert into each cavity; and connecting the flanged inlet of the turbomolecular vacuum pump to the flanged outlet of the device to be evacuated using fixing members passing through the apertures.

Figure 2:
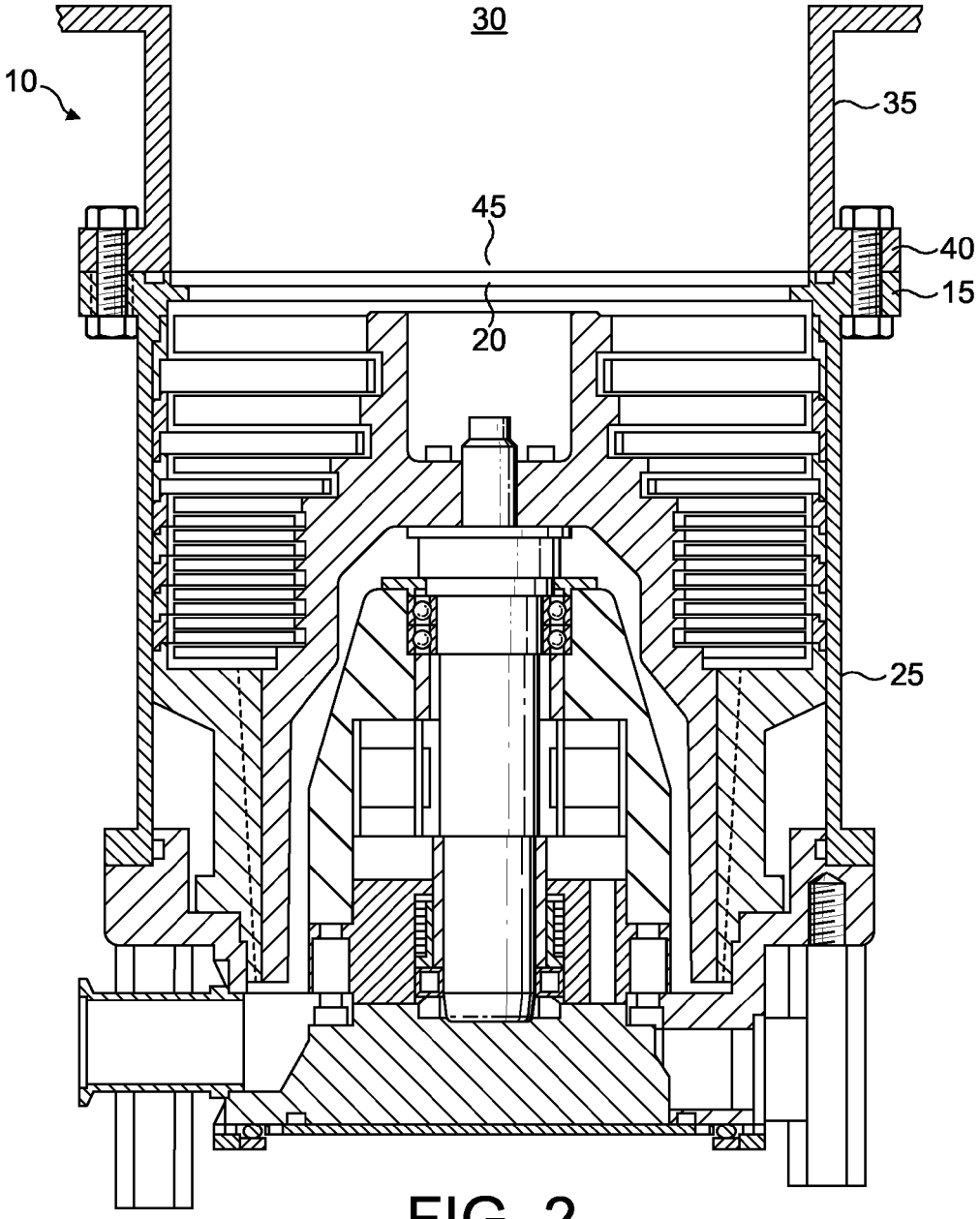
FIG. 2 illustrates a vacuum pumping arrangement comprising a turbomolecular pump connected to its associated equipment.

A vacuum pumping arrangement 10 is illustrated in FIG. 2. A flange 15 is provided at an inlet 20 to a turbomolecular vacuum pump 25 for connecting the vacuum pump to an enclosure 30 to be evacuated or to a conduit 35 which is so connected. A corresponding flange 40 is provided at the outlet 45 of the enclosure 30 or conduit 35 to which the flange 15 of the vacuum pump 25 is aligned and subsequently connected. Alternatively a separate supplementary flange or adaptor (not shown) may be connected to the outlet 45 of the enclosure 30, the vacuum pump 25 being connected thereto.

Figure 3:
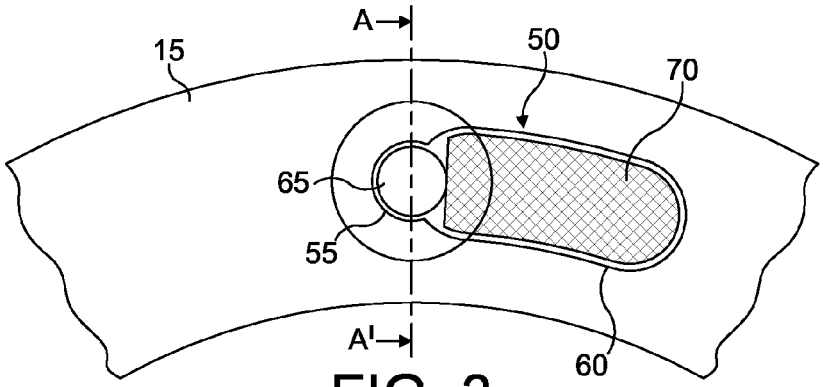
FIG. 3 illustrates a plan view of a first embodiment of an inlet flange of a turbomolecular pump having inserts embedded therein.

A plan view of a portion of a first embodiment of the flange 15 of vacuum pump 25 is illustrated in FIG. 3. A number of openings 50 are provided within the flange 15 to connect the flange 15 to the flange 40. Each of the openings 50 comprises two sections. The first section is provided by an aperture 55 that is approximately circular in section and is configured to accommodate the diameter of a fixing member 65, typically a bolt, to be located therein. Each aperture 55 extends through the thickness of the flange 15. The second section of each opening 50 is provided by cavity 60 which is located adjacent to a respective aperture 55 and is configured to accommodate a crushable insert 70.

In FIG. 3, cavity 60 is elongate and extends circumferentially from the aperture 55, preferably following the curvature of the flange. Since the cavity is formed in the flange of the vacuum pump 25, the cavity extends from the aperture 55 in a direction opposite to the normal operational direction of a rotor mechanism of the vacuum pump 25. If the cavity is formed in the outlet flange 40 to which the vacuum pump 25 is connected the cavity extends in the opposite direction, namely that corresponding to the normal operational direction of the rotor mechanism. Whether the cavity is formed in the flange 15 of the vacuum pump or the outlet flange 40 associated with the enclosure, the cavity may be configured such that it extends in both circumferential directions thereby to absorb any unforeseen excess impulse loading in either direction.

Figure 4:
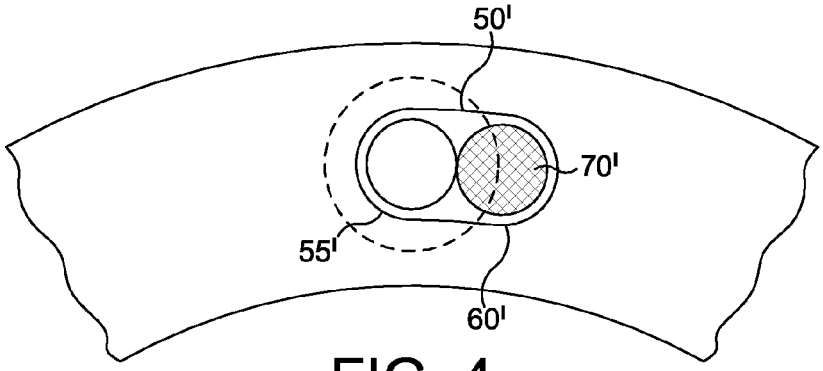
FIG. 4 illustrates a plan view of a second embodiment of a flange having inserts embedded therein.

In an alternative embodiment depicted in FIG. 4, the insert 70' is not elongate but rather is circular in cross section. As illustrated, the cavity 60' is positioned to extend circumferentially from the aperture 55'.

Figure 5:
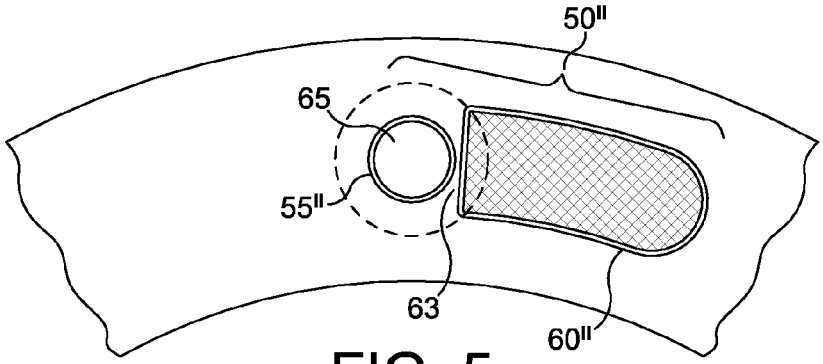
FIG. 5 illustrates a plan view of a third embodiment of a flange having inserts embedded therein.

As illustrated in FIGS. 3 and 4, the cavity 60, 60' extends from aperture 55, 55' so that a single opening 50, 50' is formed. Alternatively, the aperture 55" may be separated from the cavity 60" by a partition 63 as shown in FIG. 5 to form a divided opening 50".

Figure 6:
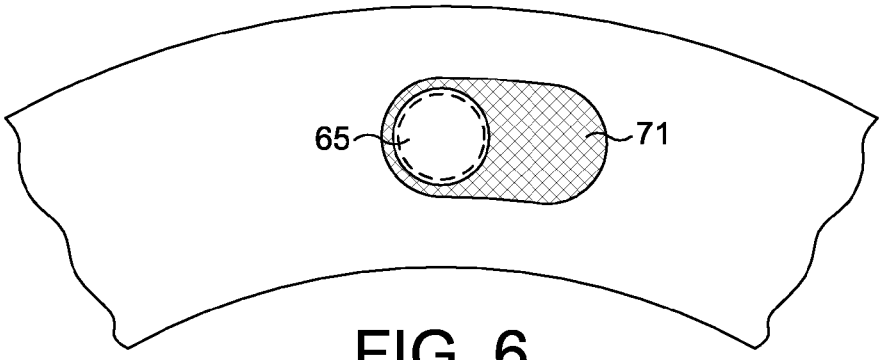
FIG. 6 illustrates a plan view of fourth embodiment of a flange having inserts embedded therein.

FIG. 6 illustrates an alternative insert 71 which comprises a bore for receiving the fixing member 65 upon assembly of the vacuum pumping arrangement.

The crushable insert 70, accommodated within the cavity 60 of the opening 50, preferably has a cellular structure, preferably either a honeycomb cellular structure or a foam structure. Example materials for the crushable insert 70 are aluminium or an aluminium alloy. Alternatively a plastics material or gel material can be used which may or may not comprise reinforcing fibres or particles.

Figure 7:
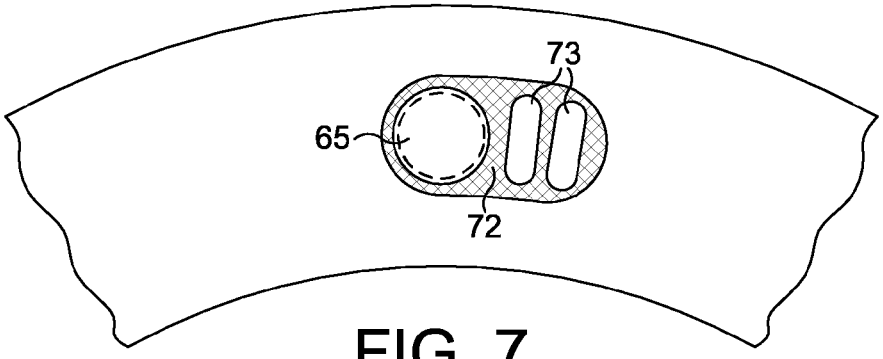
FIG. 7 illustrates a plan view of fifth embodiment of a flange having inserts embedded therein.

FIG. 7 illustrates an alternative insert 72 which comprises one or more voids 73 to increase the level of deformation and therefore energy absorption that may be accommodated by an insert formed from a plastic or gel material.

Figure 8:
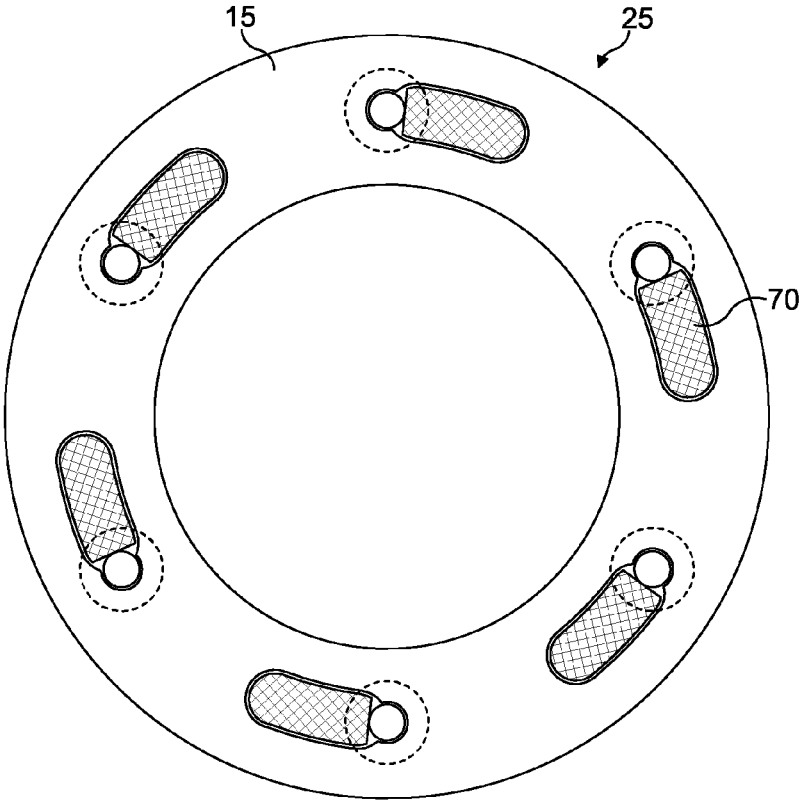
FIG. 8 illustrates a plan view of a vacuum pump inlet having a number of inserts embedded therein.

As illustrated in FIG. 8, a plurality of inserts 70 are preferably provided in the inlet flange 15 of the vacuum pump 25, the inserts being distributed around the flange and about the longitudinal axis of the pump. Alternatively, or additionally, inserts 70 may be provided in the outlet flange 40 associated with the enclosure 30.

Figure 9:
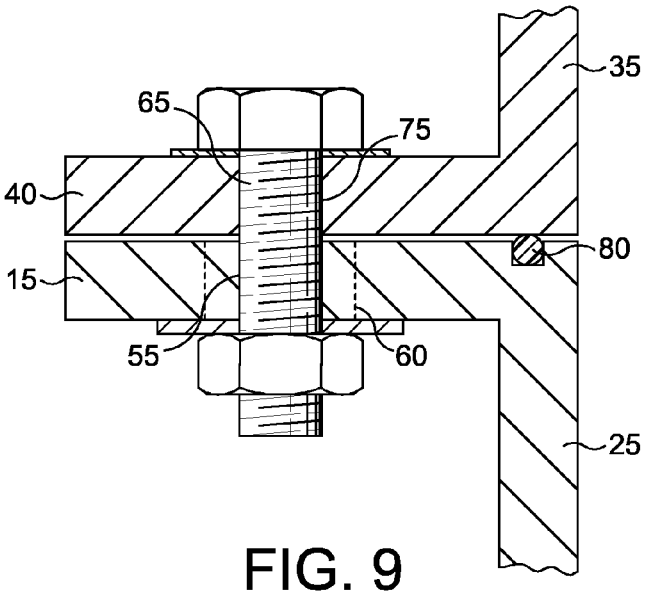
FIG. 9 illustrates a cross sectional view on line A-A' of FIG. 3.

FIG. 9 represents a cross section through line A-A' of FIG. 3 and illustrates part of an assembly in which the flange 15 of a vacuum pump 25 is connected to a flange 40 of a conduit 35 using at least one bolt 65. Aperture 75 is formed in the flange 40 and is configured to be aligned with the aperture 55 of opening 50 in the flange 15 of the vacuum pump 25. Bolt 65 is then inserted through both flanges 15, 40 and tightened to draw the flanges together such that o-ring 80 is compressed and a fluid tight seal is formed between the vacuum pump 25 and the conduit 35.

Figure 10:
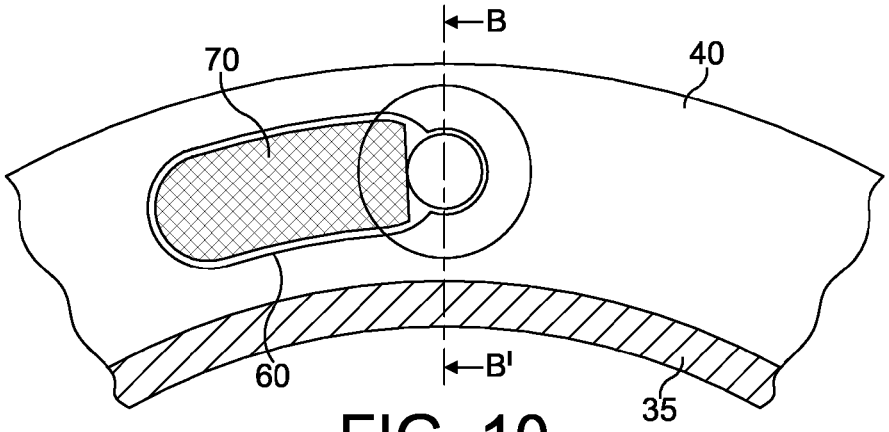
FIG. 10 illustrates a plan view of a sixth embodiment of a flange associated with the enclosure to be evacuated.

FIG. 10 illustrates an insert 70 embedded in the flange 40 associated with the outlet of an enclosure to be evacuated. When viewed from above, as here, the cavity 60 extends in a direction opposite to that described above, namely a direction corresponding to that of a rotor mechanism of the vacuum pump 25. It should be recognised that a combination of configurations could be implemented whereby some inserts are provided in the inlet flange 15 of the vacuum pump whilst others are provided in the flange 40 associated with the outlet.

Figure 11:
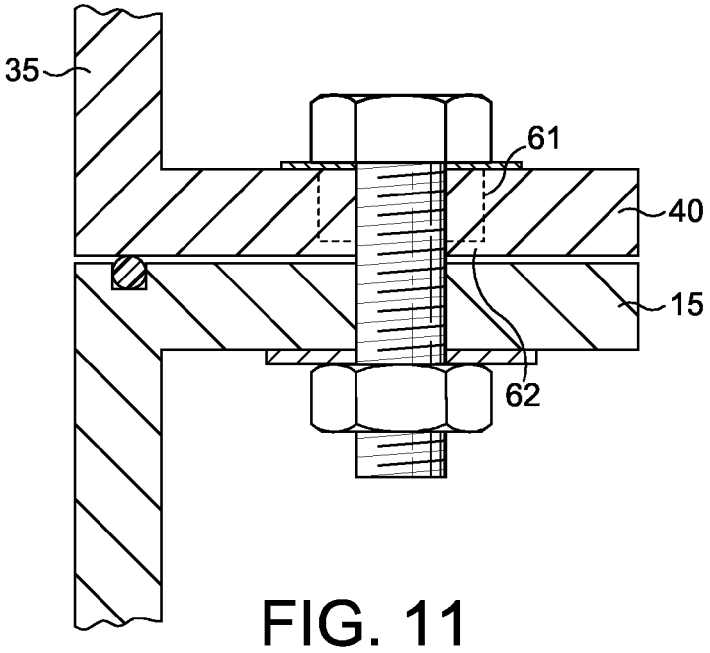
FIG. 11 illustrates a cross sectional view on line B-B' of FIG. 10.

Cavity 60 may extend through the entire thickness of flange 15 as described above or, as illustrated in FIG. 11 (notionally a cross section at B-B' of FIG. 10) it may be provided by an alternative cavity 61 which extends only through a substantial part of the thickness of the flange 40 in which it is located. The remaining material 62 at the base of cavity 61 serves to locate the fixing member 65 during connection of the pump 25 to the conduit 35.

Figure 12:
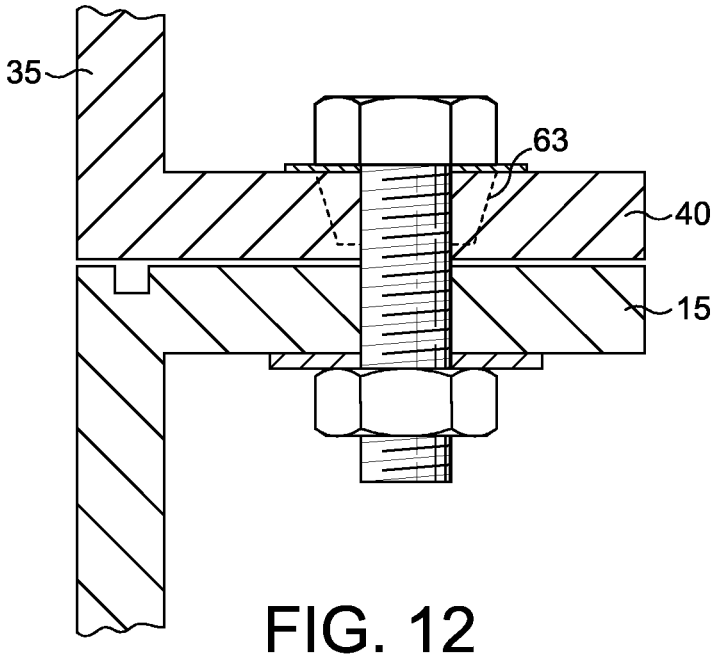
FIG. 12 illustrates an alternative cross sectional view on line B-B' of FIG. 10.

FIG. 12 illustrates means for locating an insert within the cavity upon assembly thereof. In this example, the external profile of the insert comprises a taper. As an alternative, a stepped profile could be implemented. A corresponding complementary profile is formed on the inner boundary of the cavity 63 formed in the flange 40. Such a configuration ensures that the insert is correctly seated within the cavity and remains there whilst assembly of the vacuum pumping arrangement is undertaken.

Crushable inserts 70 come into use if a fault occurs during operation of the vacuum pump 25 which results in a clashing of rotor components of the pump 25 with a housing component of the pump. During a failure of this nature, also termed a crash condition, a significant rotational impulse is imparted to the housing component of the pump 25 by the rotor components of the pump so that the housing component is inclined to rotate in the same direction as the rotor. Consequently, a significant shear loading would be applied to bolts 65 by virtue of their contact with a surface of a respective insert 70 or partition 63. However, since the inserts 70 are, by design, crushable they readily deform and hence permit some degree of relative rotational movement between the vacuum pump 25 and the apparatus to which the pump is connected. The act of crushing these inserts 70 absorbs some of the energy of the crash so that less damage is experienced by the vacuum pump and its associated apparatus.

The crushable inserts 70 preferably have a progressive resistive property such that initial deformation is achieved quite readily but as the degree of deformation is increased the resistance is correspondingly increased and further movement is inhibited. The inserts 70, therefore, act as a braking mechanism and remove energy from the system in order to retain integrity of the system and avoid projectiles being formed when a crash occurs. Hence the safety of the apparatus is enhanced.

In the event that it is desirable to absorb additional energy from the crash the configuration and material of the crushable inserts 70 can be altered to display a property of constant resistance to deformation, so that a higher level of energy is absorbed from the outset.

If cavity 61 only extends through a substantial part of the thickness of the flange 15, 40, the thickness of the remaining material 62 at the base of the cavity 61 is such that when a crash condition is experienced this material will readily deform, thus absorbing further energy from the system. Similarly, provision of a partition 63 would provide an additional source of deformable material which further enhances the energy absorption capacity of the system.

The cellular structure of the crushable insert 70 may be fully or partially encompassed by an external skin. The inserts 70 may be individually manufactured and a skin may be formed around the entire structure. Alternatively, the inserts 70 may be formed from an extruded component which is subsequently sliced into a number of portions, with each portion being bounded by an outer skin but leaving the cellular structure exposed in an axial direction. Presence of the skin provides a further component that must be deformed when the pump experiences an aforementioned crash condition, and so additional energy can be absorbed by the insert 70 through deformation of this skin, thus leading to an improved device.

While the foregoing description and drawings represent the preferred embodiments of the present invention, it will be apparent to those skilled in the art that various changes and modifications may be made therein without departing from the true spirit and scope of the present invention.

I claim:

1. A vacuum pumping arrangement for evacuating an enclosure, the arrangement comprising:

a turbomolecular vacuum pump having an inlet connectable to an outlet of an enclosure using fixing members wherein each of the fixing members passes through a respective first aperture in the inlet and through a respective second aperture in the outlet, the inlet or the outlet comprising an elongate, circumferentially extending cavity extending from or adjacent to the respective aperture, and a crushable insert having an elongate shape that is inserted within the circumferentially extending cavity so as to substantially fill the circumferentially extending cavity and so that energy transmitted to the fixing memgers by the turbomolecular vacuum pump during a failure thereof is absorbed by crushing the crushable insert in the circumferentially extending cavity to reduce damage to the inlet and the outlet during the failure wherein the crushable insert has a progressive resistive property such that as a degree of deformation of the crushable insert is increased, resistance to further deformation of the crushable insert increases;

wherein the crushable insert is formed of a plastic honeycomb structure surrounded by an external skin.

2. The arrangement according to claim 1 wherein the crushable insert comprises a void.

3. The arrangement according to claim 1 wherein the circumferentially extending cavity for receiving the insert is provided in the inlet and extends from the respective aperture in a direction opposite to the normal operational direction of a rotor mechanism of the vacuum pump.

4. The arrangement according to any of claim 1 wherein the circumferentially extending cavity for receiving the crushable insert is provided in the outlet and extends from the respective aperture in a direction corresponding to the normal operational direction of a rotor mechanism of the vacuum pump.

5. The arrangement according to claim 1 wherein the circumferentially extending cavity for receiving the crushable insert extends from the respective aperture in both circumferential directions.

6. The arrangement according to claim 3 wherein the circumferentially extending cavity is provided adjacent to the respective aperture, and is separated therefrom by a partition.

7. The arrangement according to any of claim 3 wherein the circumferentially extending cavity extends through a substantial part of the thickness of the material in which it is formed.

8. The arrangement according to claim 3 wherein the circumferentially extending cavity extends completely through the thickness of the material in which it is formed.

9. The arrangement according to claim 1 wherein the crushable insert comprises a bore for receiving a fixing member upon assembly thereof.

10. The arrangement according to claim 1 wherein the circumferentially extending cavity and the crushable insert are each provided with a complementary tapered or stepped profile for locating the crushable insert within the circumferentially extending cavity and inhibiting displacement therebetween during assembly of the vacuum pumping arrangement.

11. The arrangement according to claim 1 wherein the outlet is connected to a conduit extending from an enclosure to be evacuated.

12. The arrangement according to claim 1 comprising a plurality of crushable inserts each located in a respective cavity.

13. The arrangement according to claim 12 wherein the crushable inserts are arranged about a longitudinal axis of the vacuum pump.

14. The arrangement according to claim 1 wherein the outlet and the inlet are flanged.

15. The arrangement according to claim 14 wherein the flanged inlet is configured to receive one or more of said crushable inserts.

16. The arrangement according to claim 14 wherein the flanged outlet is configured to receive one or more of said crushable inserts.

* * * * *